US005945900A

United States Patent [19]

Shibata et al.

[11] Patent Number: 5,945,900

[45] Date of Patent: Aug. 31, 1999

[54] ELECTROMAGNETIC CONTACTOR

[75] Inventors: Katsumi Shibata; Takato Hirota; Noriyoshi Machida; Makoto Kawasaki; Etsuya Hiramatsu, all of Saitama, Japan

[73] Assignee: Fuji Electric Co., Ltd., Kawasaki, Japan

[21] Appl. No.: 08/888,299

[22] Filed: Jul. 3, 1997

[30] Foreign Application Priority Data

Jul. 3, 1996 [JP] Japan ..... 8-173140

[51] Int. Cl.[6] ..... H01F 7/00

[52] U.S. Cl. ..... 335/234; 335/128; 335/130

[58] Field of Search ..... 335/78–85, 128, 335/129, 130, 234, 236

[56] References Cited

U.S. PATENT DOCUMENTS 3,256,401 6/1966 Dawson ..... 335/129
4,509,026 4/1985 Matsushita et al. ..... 335/85

*Primary Examiner*—Lincoln Donovan
*Attorney, Agent, or Firm*—Kanesaka & Takeuchi

[57] ABSTRACT

An electromagnetic contactor includes an iron core members formed of a first core bent in a U-shape, and a second L-shaped core contacting the first core. A coil is wound around a spool disposed on an upper arm of the first core and the second core to form a main leg while a lower arm of the first core constitutes a yoke. Thus, the iron core members can be processed by a press machine operating at a normal cutting speed, and welding and polishing operations can be eliminated to thereby reduce the number of processing steps required.

9 Claims, 6 Drawing Sheets

ELECTROMAGNETIC CONTACTOR

BACKGROUND OF THE INVENTION AND RELATED ART STATEMENT

The present invention relates to an electromagnetic contactor that has a movable iron piece shaped like a hinge, and in particular, to an iron core structure for an electromagnet with reduced manufacturing costs.

FIG. 11 is a cross sectional view for showing a structure of a conventional electromagnetic contactor. An iron core 3 formed of a main leg 5 and a yoke 4, and a coil 8 wound around a spool 6 for the main leg 5 are housed in a lower case 1 with the yoke 4 installed on the bottom 1A of the lower case 1. A laterally movable holder 10 is housed in an upper case 2, and is moved to the left by the force of a return spring 7 between the holder and the side wall of the upper case 2. The movable holder 10 includes movable contacts 11 via contact springs 13. Fixed contacts 12 are fixed to the upper case 2, and contacts 12A attached to the fixed contacts l2 face the contacts 11A attached to the movable contact 11 so that the contacts can be connected to or separated from each other. The movable and the fixed contacts 11 and 12 are connected to an external main circuit via terminals (not shown).

Furthermore, an engaging section 9A of a movable iron piece 9 is fitted in a fitting section 10A of the movable holder 10 in FIG. 11. The movable iron piece 9 extends from the inside of the lower case 1 to the inside of the upper case 2, and faces the left end surfaces of the main leg 5 and the yoke 4 to be rotatably supported on the bottom 1A of the lower case 1. The upper and lower cases 2, 1 are connected.

FIG. 12 is an exploded perspective view of FIG. 11. The iron core 3 is formed of the bar-like main leg 5 and the L-shaped yoke 4, and is arranged like a character U. The coil 8 is wound around the spool 6, and the main leg 5 is inserted into and fitted in a square opening 6A penetrating through the spool 6. The movable iron piece 9 is located in front of and to the left of the spool 6, and has at the top an engaging section 9A with a reduced width.

Returning to FIG. 11, when the coil 8 is energized, the movable iron piece 9 is attracted to the iron core 3 and rotates in the clockwise direction. Thus, the engaging section 9A of the movable iron piece 9 pushes the fitting section 10A of the movable holder 10 to the right, and the movable holder 10 moves to the right by overcoming the force of the return spring 7. Then, the contacts 11A contact the contacts 12A. Under this condition, the contact springs 13 push the movable contacts 11 toward the fixed contacts 12 to thereby provide good contact between the contacts 11A and 12A. On the other hand, when the coil 8 is deenergized, the attractive force of the iron core 3 is eliminated and the force of the return spring 7 overcomes to cause the movable holder 10 to move to the left while the movable iron piece 9 is rotated in the counterclockwise direction. Then, the contacts 11A and 12A are disconnected.

The contacts 11A and 12A in FIG. 11 are contacts (A contacts) that come into contact when the coil 8 is energized. Moreover, this electromagnetic contactor may include contacts which generally contact together, but are disconnected when the coil 8 is energized (B contacts).

Conventional apparatuses, such as those described above, however, require an expensive cutter for cutting a plate for the iron core, as well as a large number of processing steps. Namely, it is required that the iron core has sufficient attractive force, the main leg must have a large cross section, and the tip surface of the main leg must have a large pole surface. Thus, a thick iron plate is used as the material of the main leg 5 as shown in FIG. 12. With a thick iron plate, the cut surface sags when a general press machine operating at a normal speed is used, resulting in a reduced pole face area with inappropriate edge angle and flatness. Consequently, a special fast cutter is used to cut the main leg 5. Although the above problem is solved by cutting the material at high speed, the fast cutter is more expensive than a general press machine due to their better performance. Thus, a general press machine is recommended for this purpose.

In addition, in FIG. 12, since the tip surface 5A of the main leg 5 and the tip surface 4A of the yoke 4 constitute pole faces, these surfaces must be polished so as to be located in the same plane, and this requires a large number of processing steps.

Furthermore, the main leg 5 and the yoke 4 are joined together by means of resistance welding, and such welding requires a large number of processing steps.

It is an object of this invention to enable an iron core to be processed by using a press machine operating at a normal cutting speed, and to eliminate the need for welding and polishing steps in order to reduce the number of required processing steps.

SUMMARY OF THE INVENTION

In accordance with the invention, an electromagnetic contactor comprising a case; a spool having an opening and a coil wound around the spool, the spool and coil being disposed in the case; iron core members having a first core and a second core; fixed and movable contacts to be connected to and separated from each other and housed in the case; and a movable iron piece.

The first core has a U-shape and is formed of an upper arm inserted into the opening of the spool and a lower arm used as a yoke and disposed on a bottom of the case. The second core has a base with one side contacting the upper arm of the first core in the opening and a tip portion located outside the opening and bent to form a pole face. The movable iron piece has a lower part rotatably supported on the bottom of the case facing end surfaces of the upper and lower arms of the iron core, and an upper part jointed with the movable contacts. The movable iron piece is rotated to allow the movable and fixed contacts to be connected to or separated from each other.

Since the iron core members or main leg comprise two members, the members to be processed have the reduced thickness. Thus, the iron core members can be processed by using a press machine operating at a normal cutting speed. In addition, this apparatus does not require welding because only the first and the second cores must be joined together.

In such a structure, the second core may be bent at a side of the movable iron piece like the character "L". This increases the pole area of the main leg and the attractive force thereof as compared with the conventional apparatuses.

In addition, in such a structure, the second core may be bent at a side of the movable iron core piece like the character "T". This also increases the pole area of the main leg and the attractive force thereof as compared with the conventional apparatuses.

In addition, in such a structure, the upper arm of the first core may be shorter than its lower arm. Thus, the tip surface of the lower arm of the first core and the tip surface of the second core may constitute pole faces, and these tip surfaces may simply be disposed so as to have a common plane with each other during the assembly of the iron core. This eliminates the need for polishing the tip surfaces disposed like the character "U" to have a common plane with each other.

In addition, in such a structure, the first and the second cores may be gripped by ribs protruding inside the case. The ribs allow the first and the second cores to be fixed and reliably positioned. As a result, the pole face at the tip surface of the lower arm of the first core and the pole face at the tip surface of the second core may be easily disposed in a plane coplanar with each other.

In addition, in such a structure, the width of the upper arm of the first core that penetrate the opening in the spool may be larger than the width of a part of the second core. Stages that make the inner width of the upper part of the opening smaller than that of the lower part may be formed at the side walls of the opening, and the upper arm of the first core may be fitted in the lower part of the opening while the second core may be fitted in the upper part of the opening. This allows the stages to serve as guides in inserting the first core into the lower part of the square opening, thereby enabling the iron core to be incorporated easily.

In addition, in such a structure, protruding portions that press one of the cores against the other core may be formed on the inner wall of the opening in the spool. This allows the upper arm of the first core and the second core to be pressed by the protruding portions to thereby cause the cores to closely contact with each other.

In addition, in such a structure, protruding portions may be formed on at least one of the surfaces of the first and second cores. This allows the upper arm of the first core and second core to be pressed by the protruding portions to thereby cause the cores to closely contact with each other.

BRIEF DESCRIPTION OF THE DRAWINGS

FIGS. 7(A) and 7(B) are cross sectional views taken along line 7—7 in FIG. 6, wherein FIG. 7(A) shows a structure of a spool, and FIG. 7(B) shows a main leg inserted into the spool of FIG. 7(A);

DETAILED DESCRIPTION OF PREFERRED EMBODIMENTS

Figure 1:
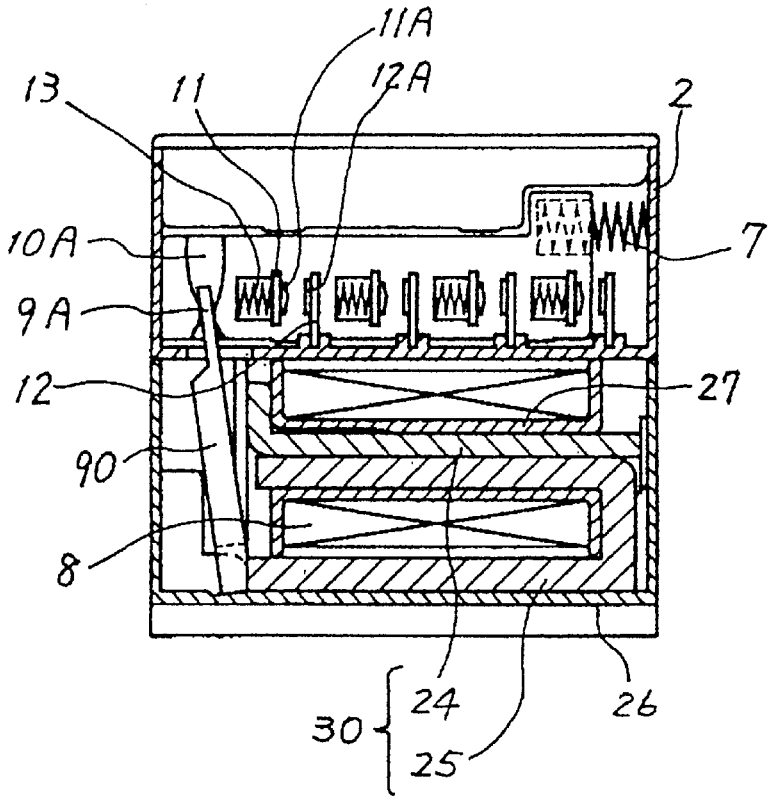
FIG. 1 is a cross sectional view for showing the structure of an electromagnetic contactor according to an embodiment of the invention.

The invention is described below with reference to the embodiments thereof. FIG. 1 is a cross sectional view showing the structure of an electromagnetic contactor according to an embodiment of this invention. This electromagnetic contactor differs from the similar conventional techniques in that an iron core or core members 30 comprises a first core 25 shaped like a character U and a second core 24 bent like a character L, in that the left-side surfaces of the first and second cores 25, 24 face a movable iron core 90, and in that the first core 25 is installed at the bottom of a lower case 26. The remaining parts of the structure are the same as those of the conventional apparatuses. Therefore, like components have the same reference numerals, and a detailed description of these components is omitted.

Figure 2:
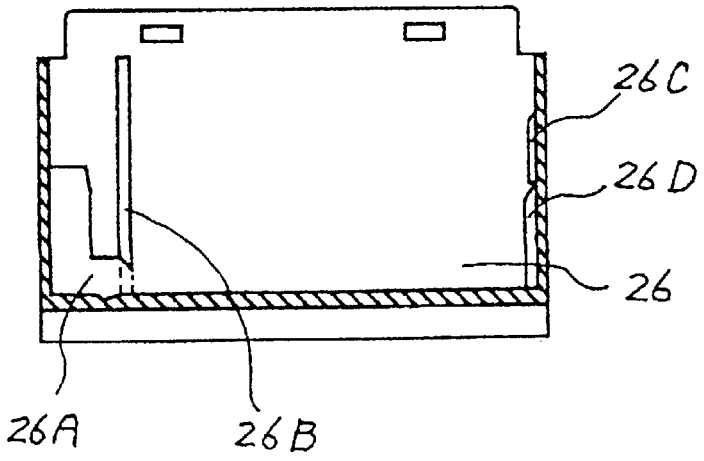
FIG. 2 is a cross sectional view of a lower case in FIG. 1.
Figure 3:
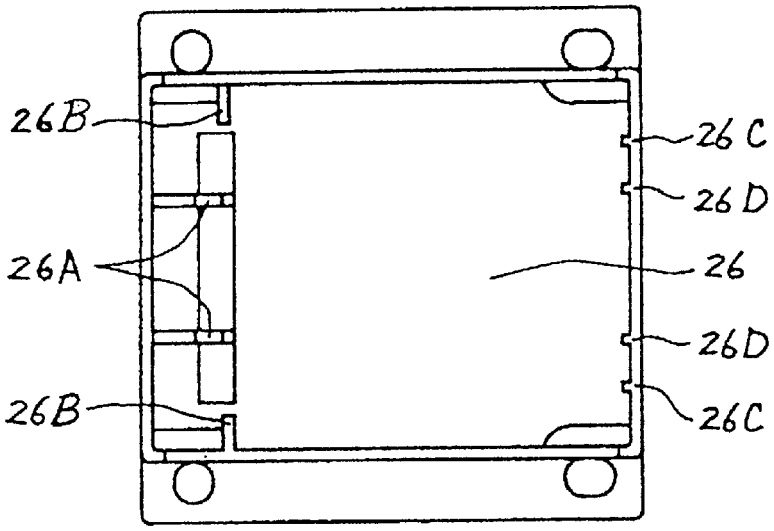
FIG. 3 is a plan view of the lower case in FIG. 1.
Figure 4:
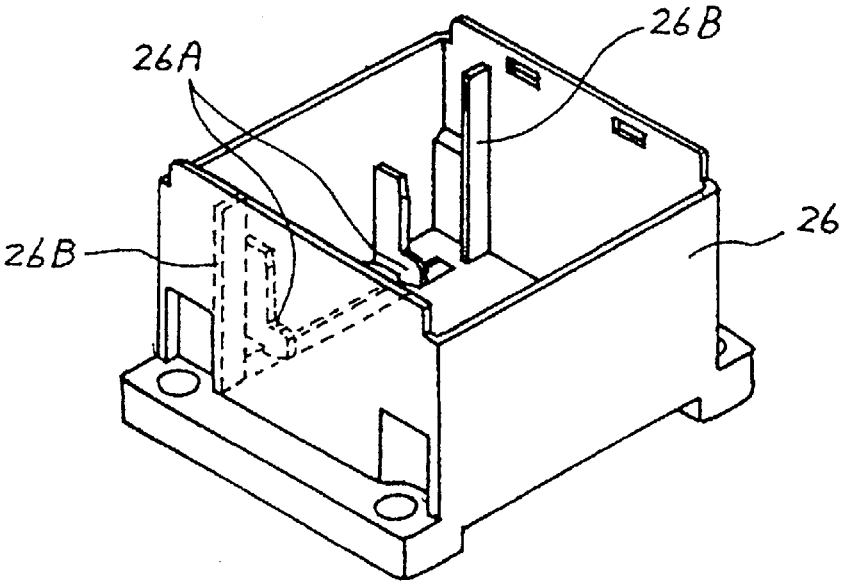
FIG. 4 is a perspective view of the lower case in FIG. 1.

FIGS. 2, 3 and 4 are a cross sectional view, a plan view and a perspective view of the lower case 26 in FIG. 1. In each figure, ribs 26A, 26B, 26C and 26D protrude inside the lower case 26, and the end surfaces of the ribs 26A are located in the same plane as the side face of the rib 26B.

Figure 5:
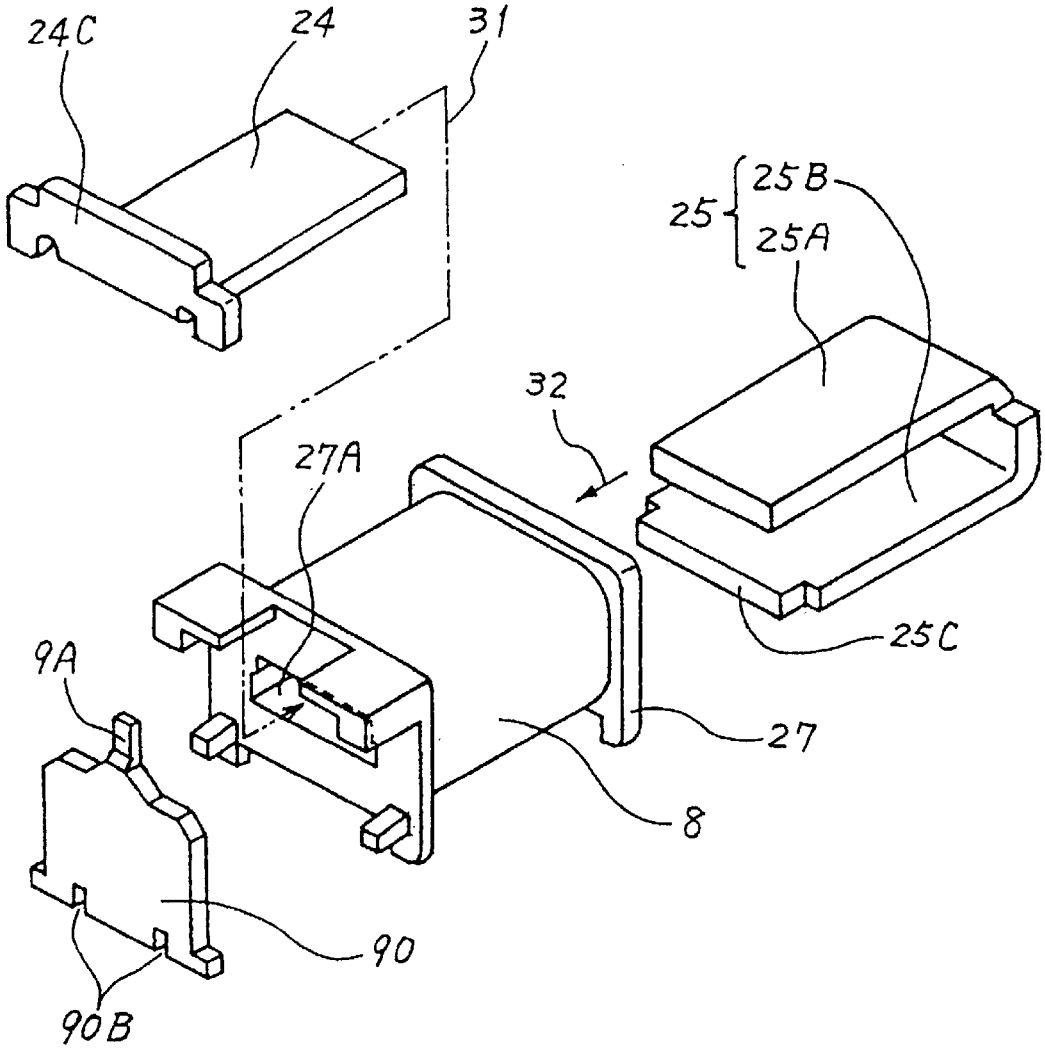
FIG. 5 is an exploded perspective view of a main part of FIG. 1.

FIG. 5 is an exploded perspective view of the main part of FIG. 1. An upper arm 25A and a lower arm 25B of the first core 25 are formed by bending an iron plate, and the upper arm 25A is inserted into a square opening 27A in a spool 27 from one side and moved in the direction shown by an arrow 32. On the other hand, the second core 24 is formed by bending an iron plate, and is inserted into the square opening 27A in a spool 27 from the opposite side along the two-dot chain line 31. The movable iron piece 90 has notches 90B in its lower part.

In FIG. 5, both the first and second cores 25 and 24 are processed by cutting an iron plate to the respective specified shapes, and then bending them. Since the main leg of the iron core comprises two members, that is, the upper arm 25A of the first core 25 and second core 24, the thickness of the members to be cut is smaller than that in conventional apparatuses. Thus, cutting can be carried out by a press machine operating at a normal cutting speed, thereby eliminating the need for an expensive fast cutter. In addition, since the first and second cores 25 and 24 are required to be joined together only during assembly, welding can be eliminated. Consequently, fewer processing steps are required as compared with the steps required in the conventional apparatuses. Furthermore, a vertical surface 24C of the second core 24, which is bent like the character L, constitutes a pole face. The area of the vertical surface 24C can be adjusted easily by changing the bent position of the second core 24. This enables the area of the pole face to be increased without increasing the thickness of the plate, thereby enhancing the attraction to the movable iron piece 90.

Figure 6:
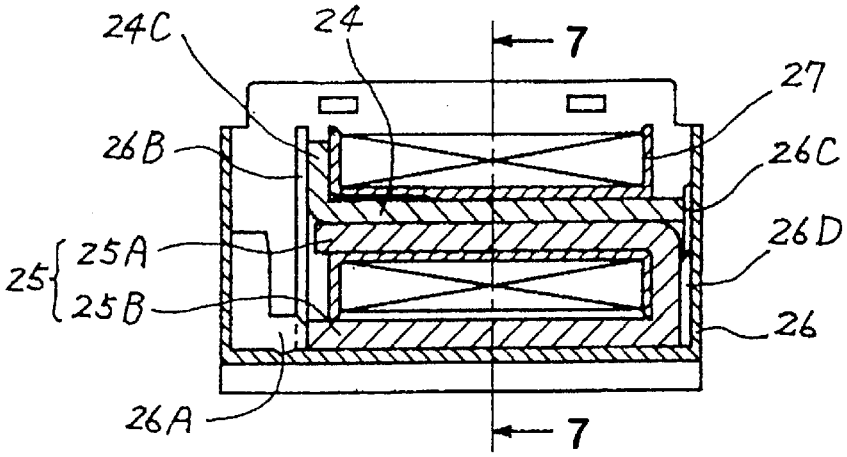
FIG. 6 is a cross sectional view for showing an iron core incorporated in the lower case in FIG. 2.

FIG. 6 is a cross sectional view for showing the iron core incorporated in the lower case in FIG. 2. The first core 25 is gripped between the ribs 26A and 26D, while the second core 24 is gripped between the ribs 26B and 26C. The left side surface of the lower arm 25B of the first core 25 must be located in the same plane as the left side surface of the vertical surface 24C of the second core 24 because they constitute pole faces. The relative positions of the ribs are such that the two ribs 26A and the two ribs 26B are disposed on the left side of the lower case 26 (the side of the movable iron piece), while the two ribs 26C and the two ribs 26D are disposed on the side wall on the right side of the lower case 26 (the side opposite to the movable iron piece). These ribs fix the first and the second cores 25 and 26, and secure their positioning. Thus, the pole faces of the first core 25 can be easily located in the same pole face of the second core 24. The notches 90B in the movable iron piece 90 in FIG. 5 are formed to prevent them from contacting the ribs 26A in the lower case 26 during rotation in FIG. 4.

In addition, in FIG. 6, the upper arm 25A of the first core 25 is somewhat shorter than its lower arm 25B. The upper and the lower arms 25A and 25B may have the same length, but by making the upper arm 25A shorter than the lower arm 25B, the movable iron core 90 constantly contacts the vertical surface 24C of the second L-shaped core 24 when the coil 8 is energized. As described before, even if the pole face of the main leg side is formed only of the vertical surface 24C of the second core 24, sufficient attractive force can be obtained because the area of the vertical surface 24C can be adjusted easily. This eliminates the need for polishing to make the left-side surfaces of the upper and the lower arms 25A, 25B in the same plane, thereby substantially reducing the number of processing steps required.

Figure 7A:
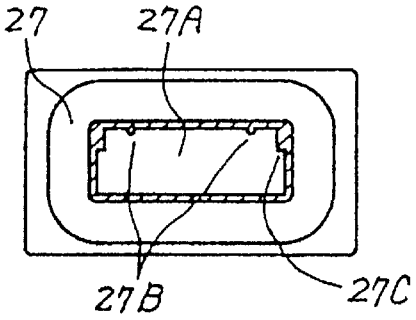
Figure 7B:
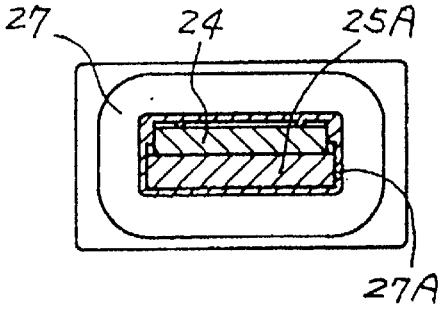

FIGS. 7(A) and 7(B) are cross sectional views of FIG. 6 taken along line 7—7, wherein FIG. 7(A) shows the structure of only the spool, and FIG. 7(B) shows the main leg fitted in FIG. 7(A). In FIG. 7(A), protruding portions 27B are formed on the upper wall of the square opening 27A in the spool 27, and stages 27C are formed on the side walls of the square opening 27A. In addition, the widths of the upper arm 25A of the first core 25 and the second core 24 are such that they can be fitted in the square opening with the stages, as shown in FIG. 7(B). Since the protruding portions 27B press the second core 24 against the first core 25 when they are inserted into the square opening 27A, the upper arm 25A of the first core 25 and the second core 24 closely contact with each other, thereby reducing the magnetic resistance loss between the second and the first cores 24, 25. In addition, when the main leg is inserted into the square opening 27A, the upper arm 25A of the first core 25 is first inserted into the square opening 27A, and then the second core 24 is inserted. Since the stages 27C serve as guides when the upper arm 25A is inserted into the square opening 27A, the upper arm 25A can be moved along the bottom of the square opening 27A, leaving a free space in the upper part of the square opening 27A to allow the second core 24 to be fitted into the hole 27A smoothly. This reduces the number of operations required during the insertion of the main leg. Instead of the protruding portions 27B, ribs may be formed on the upper wall of the square opening.

Figure 8:
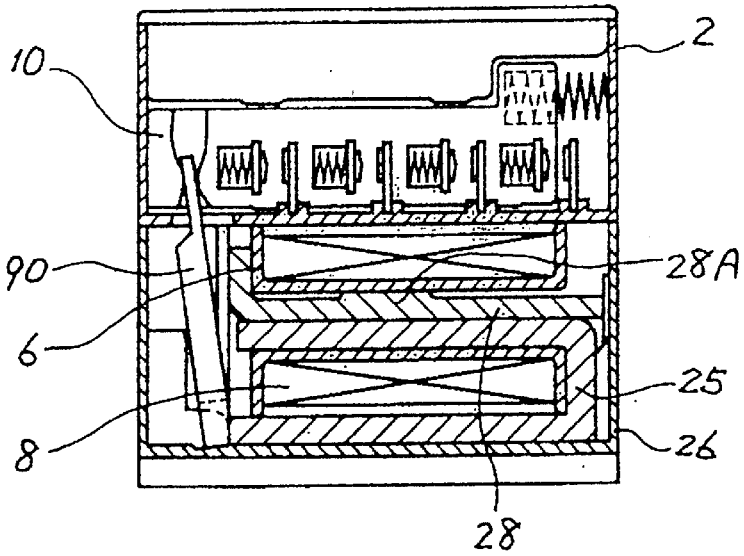
FIG. 8 is a cross sectional view for showing a structure of an electromagnetic contactor according to another embodiment of this invention.

FIG. 8 is a cross sectional view showing the construction of an electromagnetic contactor according to a different embodiment of this invention. This embodiment differs from the structure in FIG. 1 in that a second core 28 includes protruding portions 28A. The remaining parts of the structure are the same as those shown in FIG. 1.

Figure 9:
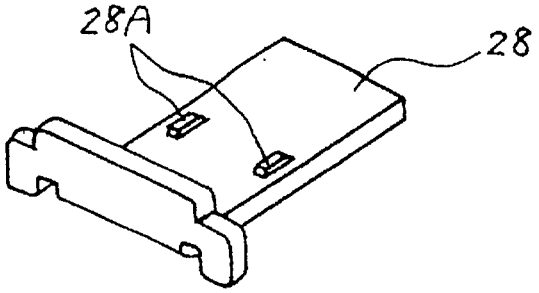
FIG. 9 is a perspective view for showing the structure of a second core in FIG. 8.

FIG. 9 is a perspective view showing the structure of the second core 28 in FIG. 8. Two protruding portions 28A are provided on the side of the second core 28 opposite to the side that contacts the first core. The protruding portions 28A function like the protrusions 27B in FIG. 7(A) and correspond to the protrusions 27B mounted on the second core 28. Thus, the first core 25 and the second core 28 sufficiently contact with each other, thereby reducing the magnetic resistance loss between the second core 28 and the first core 25. Although this embodiment includes the protrusions 28A on the second L-shaped core 28, the protrusions may be provided on the first core shaped like the character "U" or on both the second L-shaped core 28 and the first U-shaped core.

Figure 10:
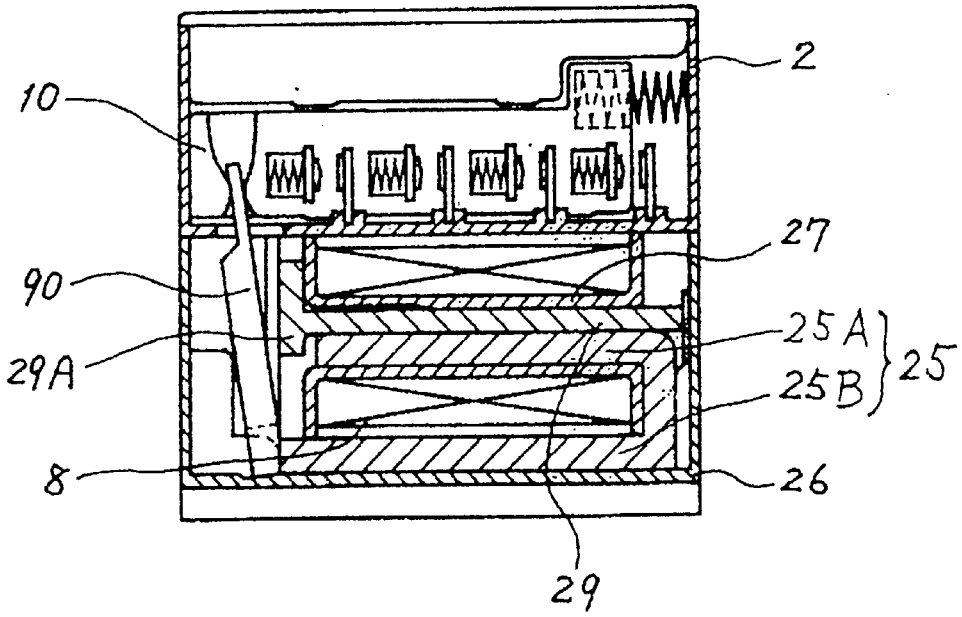
FIG. 10 is a cross sectional view for showing the structure of an electromagnetic contactor according to yet another embodiment of this invention.
Figure 11:
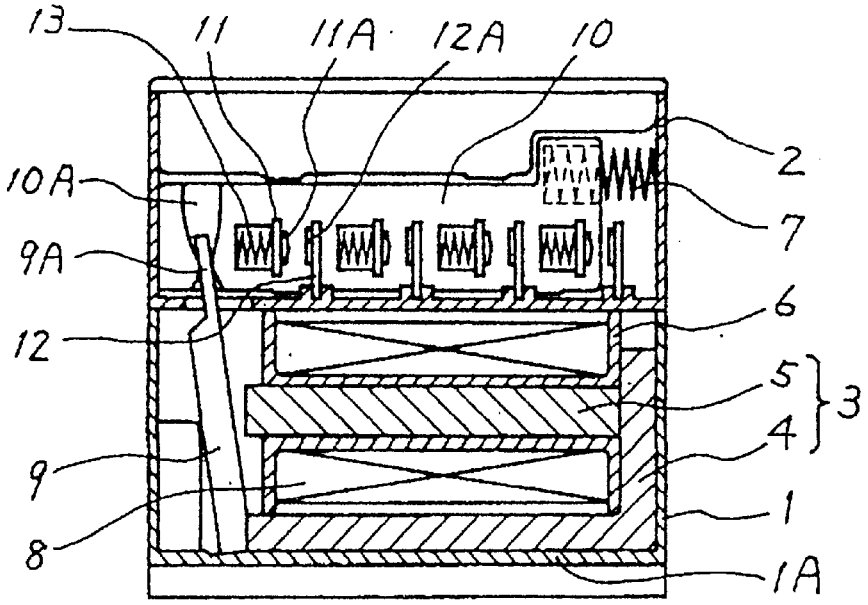
FIG. 11 PRIOR ART
FIG. 11 is a cross sectional view for showing the structure of a conventional electromagnetic contactor.
Figure 12:
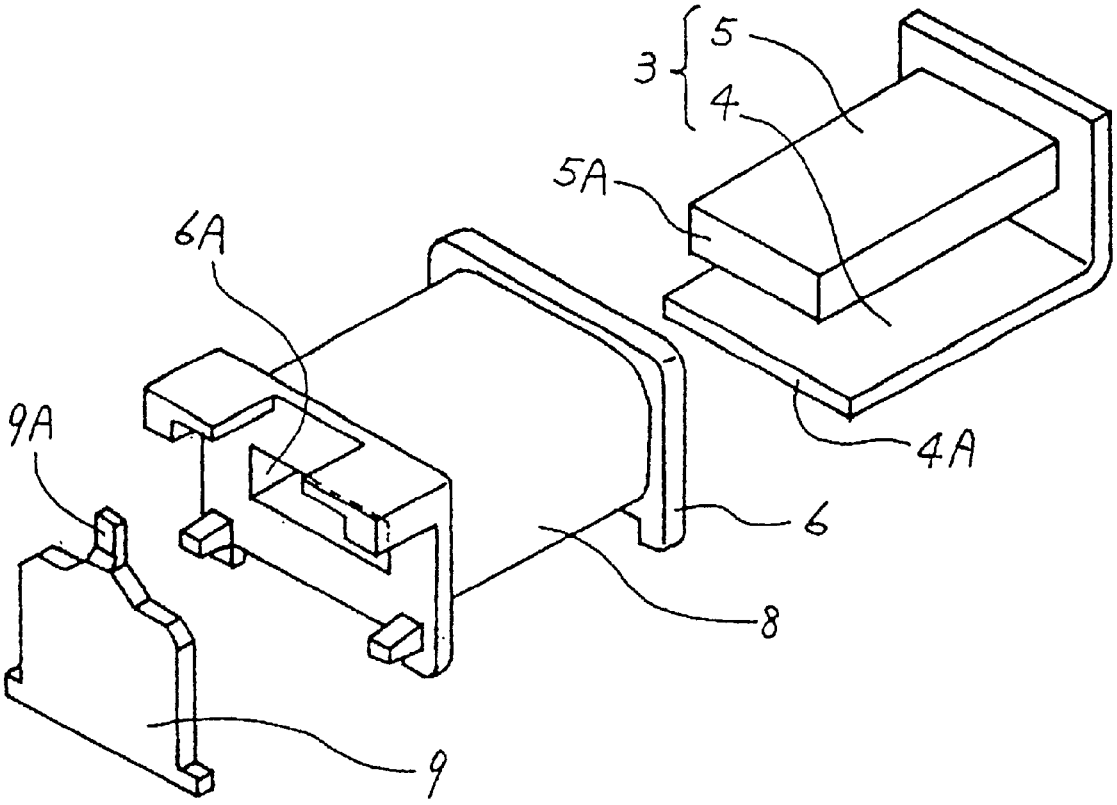
FIG. 12 PRIOR ART
FIG. 12 is an exploded perspective view of the main part of FIG. 11.

FIG. 10 is a cross sectional view showing the structure of an electromagnetic contactor according to a yet another embodiment of this invention. This embodiment differs from the structure in FIG. 1 in that a second core 29 is T-shaped at the movable iron piece side, while the remaining parts of the structure are the same as shown in FIG. 1. A vertical surface 29A at the left end of the second core 29 is processed by, for example, forging. The vertical surface 29A constitutes a pole face and acts like the vertical surface 24C in FIG. 5. This structure enables the area of the pole face of the second core 29 to be adjusted easily in order to provide sufficient attractive force, and eliminates the need for polishing to make the left-side surfaces of the upper and the lower arms 25A, 25B of the first core 25 to be located in the same plane, thereby significantly reducing the number of processing steps required.

As described above, according to this invention, the iron core comprises the first core bent like the character U with the second core contacting the upper arm of the first core; the main leg comprises the upper arm of the first core and the second core; and the yoke comprises the lower arm of the first core. This enables the iron core to be processed by using a press machine operating at a normal cutting speed, thereby reducing manufacturing facility costs. In addition, this constitution eliminates the need to weld the components of the iron core, thereby significantly reducing the number of processing steps required.

In such a structure, the second core at the movable iron piece side is bent like the character L to thereby increase the pole area of the main leg and its attractive force so that it is greater than that of the conventional apparatus.

In addition, in case the second core at the movable iron piece side is bent like the character T, the pole area of the main leg and its attractive force can be increased so that it is greater than that of the conventional apparatus.

In addition, in case the upper arm of the first core is shorter than its lower arm, polishing of the tip surfaces of the core shaped like the character U, which is required in the conventional steps, is not required, thereby further reducing the number of processing steps required.

In addition, in case the first and the second cores are gripped by the ribs protruding inside the case, the first and the second cores can be reliably fixed and positioned. As a result, the iron core can be assembled easily and positioned reliably.

In addition, in case the width of the upper arm of the first core is larger than the width of the second core where they penetrate the square opening in the spool, the stages that make the inner width of the upper part smaller than that of the lower part are formed on the side walls of the square opening, and the upper arm of the first core is fitted in the lower part of the square opening while the second core is fitted in the upper part of the square opening. This allows the stages to serve as guides in inserting the first core into the lower part of the square opening, thereby enabling the iron core to be incorporated easily.

In addition, in case the protruding portions that press one of the cores against the other core are formed on the inner wall of the square opening in the spool, the magnetic resistance loss between the first and second cores is reduced.

In addition, in case the protruding portions are formed on at least one of the surfaces of the first and second cores, the magnetic resistance loss between the first and second cores is reduced.

What is claimed is:

1. An electromagnetic contactor comprising:

a case, a spool having an opening and a coil wound around the spool, said spool and coil being disposed in the case, iron core members including a first core having a U-shape and being formed of an upper arm inserted into the opening of the spool and a lower arm used as a yoke and disposed on a bottom of the case; and a second core having a base with one side contacting the upper arm of the first core in the opening and a tip portion located outside the opening and bent to form a pole face, fixed and movable contacts to be connected to and separated from each other and housed in the case, and a movable iron piece having a lower part rotatably supported on the bottom of the case facing end surfaces of the upper and lower arms of the iron core members, and an upper part jointed with the movable contacts, said movable iron piece being rotated to allow the movable and fixed contacts to be connected to and separated from each other.

2. An electromagnetic contactor according to claim 1, wherein said case includes protruding portions inside thereof, said first and the second cores being gripped by the protruding portions installed in the case.

3. An electromagnetic contactor according to claim 1, wherein said tip portion of the second core is bent in an L-shape at a side of the movable iron piece.

4. An electromagnetic contactor according to claim 1, wherein said tip portion of the second core is bent in a T-shape at a side of the movable iron piece.

5. An electromagnetic contactor according to claim 1, wherein said upper arm of the first core is shorter than the lower arm.

6. An electromagnetic contactor according to claim 1, wherein said case further includes ribs protruding inside the case, said first and the second cores being gripped by the ribs.

7. An electromagnetic contactor according to claim 1, wherein the width of the upper arm of the first core is greater than the width of the base of the second core; and the spool has stages inside the opening to form an upper part and a lower part, an inner width of the upper part being smaller than that of the lower part, said upper arm of the first core being fitted in the lower part of the opening and the base of the second core being fitted in the upper part of the opening.

8. An electromagnetic contactor according to claim 1, wherein said spool has protruding portions on an inner wall of the opening to press one of the cores against the other.

9. An electromagnetic contactor according to claim 1, further comprising protruding portions formed on at least one of surfaces of the first and the second cores.

* * * * *